US005971314A

United States Patent [19]

Essert

[11] Patent Number: 5,971,314

[45] Date of Patent: Oct. 26, 1999

[54] FRICTION WINDING SHAFT

[76] Inventor: Hermann Essert, Rheingaustrasse 77b, D-64807, Dieburg, Germany

[21] Appl. No.: 09/035,085

[22] Filed: Mar. 5, 1998

[30] Foreign Application Priority Data

Mar. 6, 1997 [DE] Germany ..... 197 09 078

[51] Int. Cl.[6] ..... B65H 18/08

[52] U.S. Cl. ..... 242/530.3; 242/571.1; 242/571.2

[58] Field of Search ..... 242/571.1, 571.2, 242/530.3

[56] References Cited

U.S. PATENT DOCUMENTS

| | | | |
|---|---|---|---|
| 4,220,291 | 9/1980 | Papa | 242/530.3 |
| 4,461,430 | 7/1984 | Lever | 242/530.3 |
| 5,451,010 | 9/1995 | Heuser | 242/530.3 |
| 5,460,339 | 10/1995 | Drew | 242/572 |
| 5,797,473 | 8/1998 | Schulze et al. | 192/77 |

FOREIGN PATENT DOCUMENTS

| | | |
|---|---|---|
| 429 876 A2 | 6/1991 | European Pat. Off. . |
| 35 19380 A1 | 12/1986 | Germany . |
| 38 04650 A1 | 8/1989 | Germany . |
| 89 09 225 U | 2/1990 | Germany . |
| 40 09849 A1 | 7/1991 | Germany . |
| 93 08 311 | 9/1993 | Germany . |
| 44 40 559 A1 | 3/1995 | Germany . |
| 2-132043 | 5/1990 | Japan . |
| 1 516 114 | 6/1978 | United Kingdom . |

*Primary Examiner*—Donald P. Walsh
*Assistant Examiner*—Minh-Chau Pham
*Attorney, Agent, or Firm*—Larson & Taylor

[57] ABSTRACT

The friction winding shaft is used to wind up materials in strip form onto coil cores (16). It comprises a core shaft (20) annularly surrounded by friction elements (12), as well as radially acting tension elements (24), which in the operating position bring about a frictional engagement between the coupling elements (28) slaved by the core shaft (20) and the friction elements (12), by means of which engagement torque can be transmitted with slip from the core shaft (20) to the friction elements (12). The friction elements (12) are movable outward in order in operation to establish a rotationally fixed connection between the friction elements (12) and the coil core (16). With the goal of assuring slip-free slaving of the coil core at a certain torque, it is proposed that the tension elements (24), by means of the radial forces they impose, move the friction elements (12) radially outward via the coupling elements (28) and put them in contact with the coil core. Under the radial forces of the tension elements (24) effective in the operating position, the torque transmitted by the frictional pairing of the coupling element and friction element is intended to be lower than the torque that can be transmitted by the pairing of friction element and coil core, so that a rotationally fixed slaving occurs between the friction element (12) and the coil core (16).

10 Claims, 5 Drawing Sheets

FRICTION WINDING SHAFT

Figure 1:
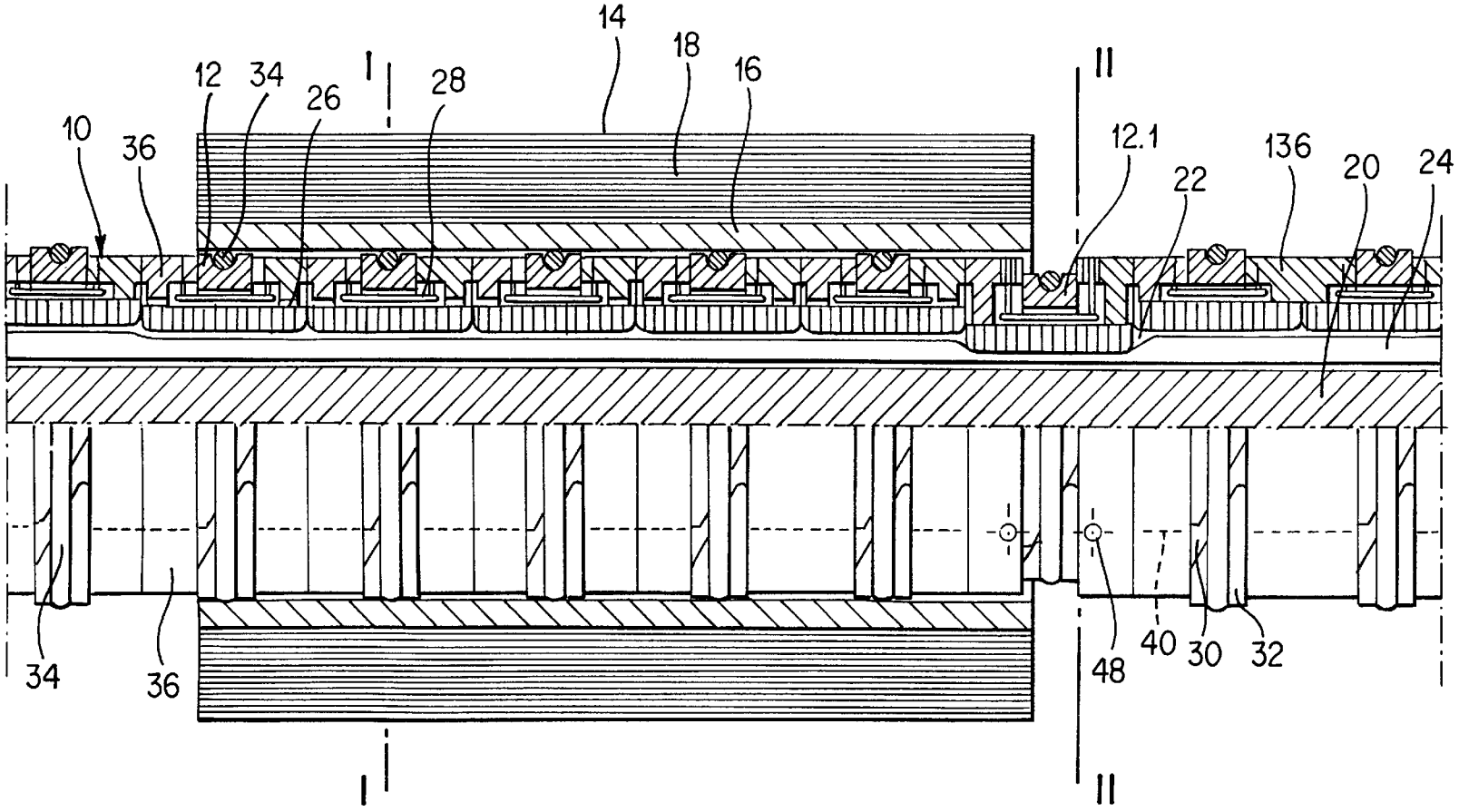

The invention relates to a winding shaft for winding striplike materials onto coil cores, having a driven core shaft, friction elements that annularly surround the core shaft, and radially acting tension elements, which in the operational position bring about a frictional engagement between coupling elements, slaved by the core shaft, and the friction elements, by which torque can be transmitted with slip from the core shaft to the friction elements, the friction elements being movable outward, in order to establish a rotationally fixed connection during operation between the friction elements and the coil core.

When more than one coil of striplike materials (polyester films, polypropylene films, metal foils, and others) are wound onto a winding shaft, core shafts equipped with friction elements are needed in order to enable kinematically decoupling the individual coils and imposing defined torques. The goal to be attained is that all the coils, regardless of their specific strip width, are stressed with specifically equal web tensions, in order to avoid creasing and strain inside the cutting machine and the destruction of individual strips of material.

Embodiments are known in which friction elements are axially fastened on a shaft and slaved via coupling rings. Each individual friction element has a device for tensing the coil cores. These constructions are often very complicated and expensive, require a great deal of space, and can be achieved only with difficulty where the core diameters are small.

German Patent Disclosure DE 40 09 849 shows one of these constructions, in which a complicated contact-pressure device is also assigned to each friction element.

In order to obtain web tensions that are always specifically the same for different coil widths, the winding shaft must be equipped with friction elements that are very close together. Wide coils must be driven by a plurality of friction elements, and the slaving of the coil core is not reliably assured via each individual mechanical tensioning device of the friction elements. Wound rolls that are driven via a plurality of friction elements can often be disconnected from the tensioning devices and removed from the winding shaft only with difficulty. In German Patent Disclosure DE 38 04 650, in order to tense the coil cores, each friction element is provided with one pneumatically actuatable ring element. This leads to considerable problems with the air supply. Moreover, abrasion can develop between the ring element and the coil core if, when there is only a partial overlap, the tensioning surface area is not sufficient to transmit the torque.

Winding shafts with friction elements are also known in which a pressure element in the shaft is acted upon by a force in the radial direction in order to generate a frictional moment. German Patent Disclosure DE 35 19 380 shows one version in which the frictional moment is generated directly between the coil core and a clamping piece. By the sliding motion directly on the inside diameter of the coil core, the coil core also requires axial guidance, for instance by the shoulder rest described there. Since the coil cores are often made of cardboard, considerable abrasion can be expected, and in many cases this can make the product wound up on the rolls useless. Another unfavorable aspect is that the clamping pieces must be adapted exactly to the core lengths. Changing the widths that are to be produced requires re-equipping the winding shaft.

Another version is described by European Patent Application 0 429 876. The fastening of the coil core is accomplished by clamping bodies, which because of the rotary motion of the core shaft move along an eccentric path and are pressed against the core. The magnitude of the radial contact-pressure force depends on the magnitude of the torque transmitted. Depending on the design of the eccentric, the slaving is not reliably assured, or else self-locking creates difficulties in removing the coil. Also, these systems can often be used only for one rotational direction.

Another version with radial friction elements is shown in German Utility Model G 89 09 225.2. Once again, the coil core is slaved via clamping bodies (balls). The problems of torque transmission and removal of the finished roll are as above. The system is suitable for only one rotational direction.

The object of the invention is to create a winding shaft of simple design which reliably assures slip-free slaving of the coil core at a certain torque.

According to the invention, this object is attained by a winding shaft of the type described at the outset, in which the tension elements, by means of the radial forces imposed by them, move the friction elements radially outward via the coupling elements and put them in contact with the coil core; and under the radial forces of the tension elements effective in the operating position, the torque transmitted by the frictional pairing between the coupling element and the friction element is lower than the torque that can be transmitted by the pairing of friction element and coil core, so that a rotationally fixed slaving occurs between the friction element and the coil core.

The advantage of the invention is first that by means of a single tensioning operation, both the torque transmission from the core shaft to the friction elements and the fastening of the coil core to the friction elements are accomplished. It is thus simultaneously assured that all the friction elements located in the vicinity of a coil core participate in the torque transmission, and that regardless of the length of the coil cores, specifically equal web tensions result. The rotationally fixed slaving of the coil core is effected not via self-locking effects between the coil core and slaving means movable relatively to it in the direction of rotation, but rather solely by pressing the friction elements against the coil core in the radial direction. As a result, seizing of the coil core, which makes it more difficult to remove to coil cores from the winding shaft once the winding process has been concluded, cannot occur, either. In addition, fastening the coil core requires no additional clamping means, which would make the design of the winding shaft considerably more complicated and expensive.

Still another advantage of the winding shaft of the invention is that the torque that can be transmitted from the core shaft to the friction elements via the coupling elements is controllable directly via the radial forces exerted by the tension elements, without having to fear uncontrolled seizing of the coil core at relatively high torque.

The rigid slaving of the winding shaft can be accomplished by either positive engagement or nonpositive engagement between the friction elements and the coil core. To generate a sufficient nonpositive engagement for the rotationally fixed slaving by way of a frictional pairing between the friction elements and the coil core, it is usually necessary that the frictional pairing of the friction element and coil core have a coefficient of friction that is markedly higher than that of the frictional pairing of a coupling element and a friction element. In this respect, the case where the torque transmitted via the coupling elements to the friction elements from the core shaft is increased by increasing the radial forces is not a problem. Specifically, increasing the radial forces at the same time increases the maximum torque that can be transmitted by the two frictional pairings.

In a preferred feature of the invention, the friction elements disposed in the same axial position form a friction ring, which is expediently axially guided between itself with support rings that rotate with the core shaft. This averts axial creep of the friction ring and coil core.

To make it easier to remove the coil cores after the winding, an elastic restoration of the friction ring out of the operating position is advantageous. One possibility of elastic restoration is for the friction ring to be in one piece, with or without a dividing seam, and to comprise elastic material. If the friction ring comprises at least two less-elastic ring parts, then these ring parts are preferably prestressed in the direction of their position of repose by elastic restoring means.

The elastic restoring means may for instance comprise an elastic ring, which wraps around the split rings and is seated in a circumferential groove. The elastic ring can form part of the frictional surface between the friction ring and the coil core. This makes use of the fact that many intrinsically elastic materials, such as natural rubber, have not only good, durable elasticity properties but also high coefficients of friction.

To improve the restoration, it is advantageous if the coupling elements are also prestressed by elastic means in the direction of their position of repose. By way of example, these elastic means may be spring clips, which are provided between the coupling elements and the support ring and are connected to the support ring in a rotationally fixed manner. A restoring force exerted directly on the coupling elements has the advantage that it does not affect the force ratio of the two frictional pairings.

In a further preferred feature of the invention, it is provided that instead of the spring clips for restoring the coupling elements, an elastic ring extends in a circumferential groove of a restoring ring that in the operating position exerts a radial restoring force only on the coupling elements, and upon a transition to the position of repose slaves the split friction rings radially inward. Such an embodiment has the advantage that the separate restoring means for the friction rings can be omitted. Such restoring means have the disadvantage of decreasing the normal to surface force at the frictional pairing of friction elements and coil core relative to the normal to surface force at the frictional pairing of coupling elements and friction elements. This difference in normal to surface force, in restoring means acting on the friction elements, must be compensated for by increasing the difference in the coefficients of friction of the two frictional pairings. Conversely, in the operating position, the restoring ring urges only the coupling elements radially inward. It is nevertheless assured that the friction elements are slaved radially inward at the transition from the operating position to the position of repose. This is preferably achieved by providing a radial play in the operating position between the restoring ring and the split friction rings, which play is less than the restoring distance of the friction rings; expediently, the restoring ring is located between two friction rings that can be actuated in pairs.

In a preferred feature of the invention it is also provided that a plurality of friction rings are disposed in axial succession on the winding shaft. This takes into account the fact that usually a plurality of coil cores are to be wound parallel on one winding shaft. In that case it is necessary to be able to compensate independently for differences in rotary speed of adjacent cores, which can be due to different coil diameters. Moreover, wide coil cores should be driven via a plurality of friction elements, in order to prevent the winding moment, in relation to the strip width, from becoming too low and to prevent the strip from being wound with an overly low tension.

In another preferred feature of the invention it is provided that the tension elements comprise one or more pressure chambers, which upon pressure imposition in the operating position exert a radially outward-oriented force on the coupling elements. Such an embodiment of the tension elements offers the advantage that compressed air or pressure fluid can easily be introduced in a known manner into the shaft, which for instance is drilled so as to be hollow. By way of the pressure of the air or liquid, the radial force exerted on the friction elements and thus the torque that can be transmitted can also be controlled easily.

In a preferred further feature of the tension elements, it is provided that a plurality of circumferentially distributed, axially extending, elastic, tubular pressure chambers are disposed between the core shaft and the coupling elements. The advantage of such an arrangement is that friction elements located axially side by side can be triggerable in parallel via the elastic hoses, so that separate tension elements are not required for each friction ring.

The elastic pressure chambers, which are to be acted upon with pressure optionally individually or in groups in order to obtain a graduated radial tensioning force, may for instance be disposed in axial grooves in the core shaft and can dispense the radial tensing force to the associated one piece or multi-part coupling elements via pressure elements guided radially in the groove. A radial rotational securing of the coupling elements with regard to the core shaft is obligatory, for instance by rigidly connecting the pressure elements and the coupling elements to one another, or by retaining the coupling elements in radial indentations in the core shaft.

An especially simple version that makes do with only one elastic pressure chamber provides that the shaft is embodied as a hollow shaft, and that the elastic pressure chamber is disposed in its hollow space, which chamber in the operating position exerts the radial tensing force on the coupling elements, via pressure elements guided in radial through openings in the wall of the hollow shaft. The manufacture of the shaft is also simplified considerably in such an embodiment.

In the case of a coil core extending over a plurality of friction rings located side by side, it can happen that the friction ring located at the edge of the coil core can no longer be brought into a defined contact with the inside of the coil core. In such cases, it is desirable for the latter friction ring to be brought to a stop, in order to prevent it, when it seeks to assume its operating position, from damaging the edge of the coil core. In still another preferred feature of the invention, it is therefore provided that each support ring can be rotated counter to the core shaft into a position in which the associated coupling elements are blocked even if the tension elements are activated. This can be done for instance with the aid of a support ring, which on its inside circumference has a number of recesses corresponding to the number of pressure elements distributed over the circumference, into which recesses parts of the pressure elements can be introduced in order to attain the operating position. To avoid relative rotation between the support ring and the core shaft during operation, it is provided in a preferred further feature that shallow grooves are located between the recesses in the support ring, and parts of the pressure elements lock into these grooves in the blocked position. To simplify operation and for the sake of simplicity it is expedient if the outer circumferential surface of each support ring be provided with a marking, which indicates the relative position with regard to the adjacent support rings, or if the marking is a hole, indicates the relative position with regard to the core shaft.

A preferred further feature of the intention provides that over the length of the winding shaft on the outside of the support rings, at least two guide rings are rotatably supported, their outside diameter being slightly smaller than the inside diameter of the coil cores but greater than the maximum outer diameter of the support rings. The guide rings offer the advantage that the coil cores can be centered quite exactly on the winding shaft even when the friction elements are in the position of repose. Otherwise it can happen that at the transition to the operating position, not all the friction elements will traverse the same radial distance before coming to be braced against the inside face of the coil core, which can lead to eccentric fastening of the coil cores. Expediently, there is one guide ring between each two friction rings, and for reasons of space, needle bearings are expedient for supporting the friction rings.

Figure 2:
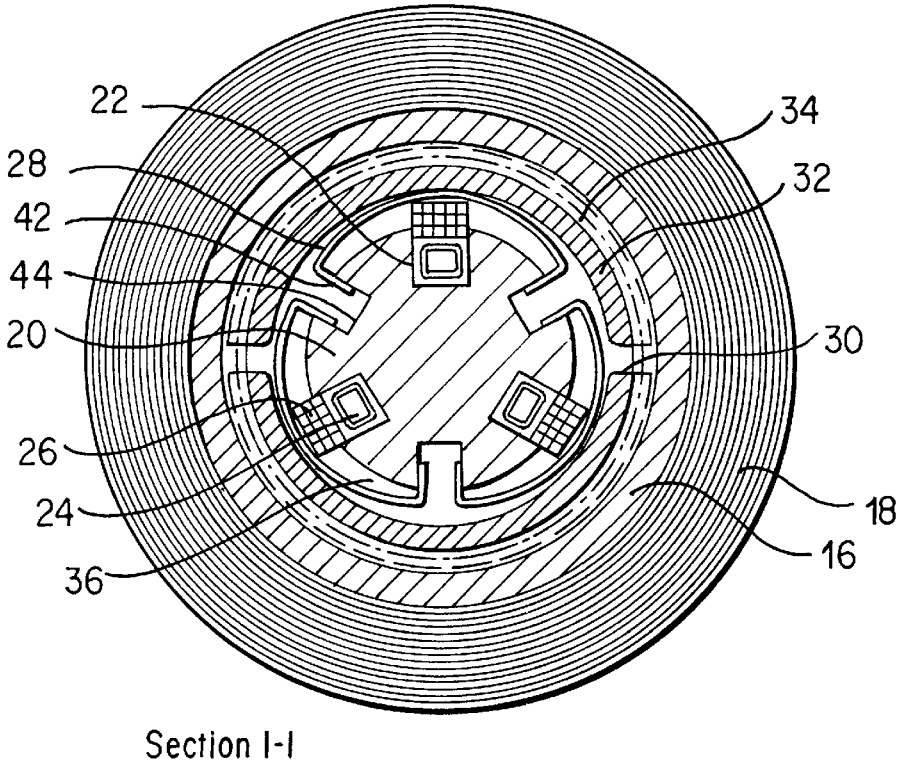
Figure 3:
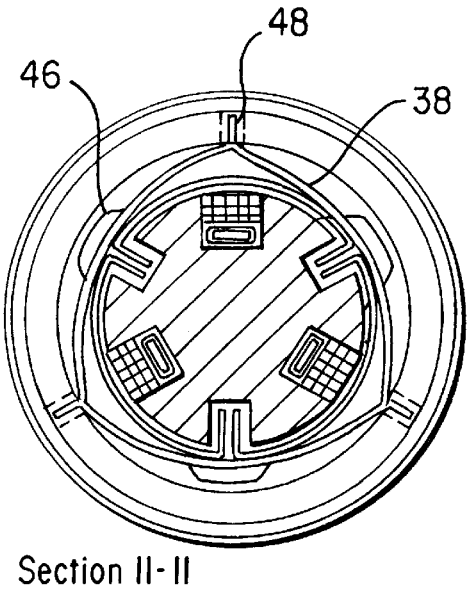
Figure 4:
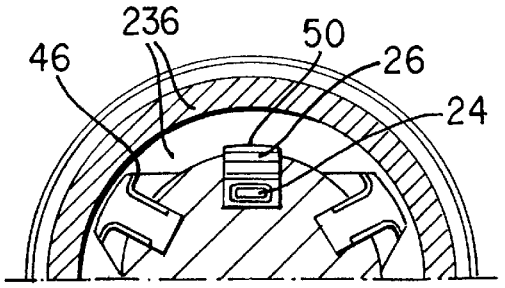
Figure 5:
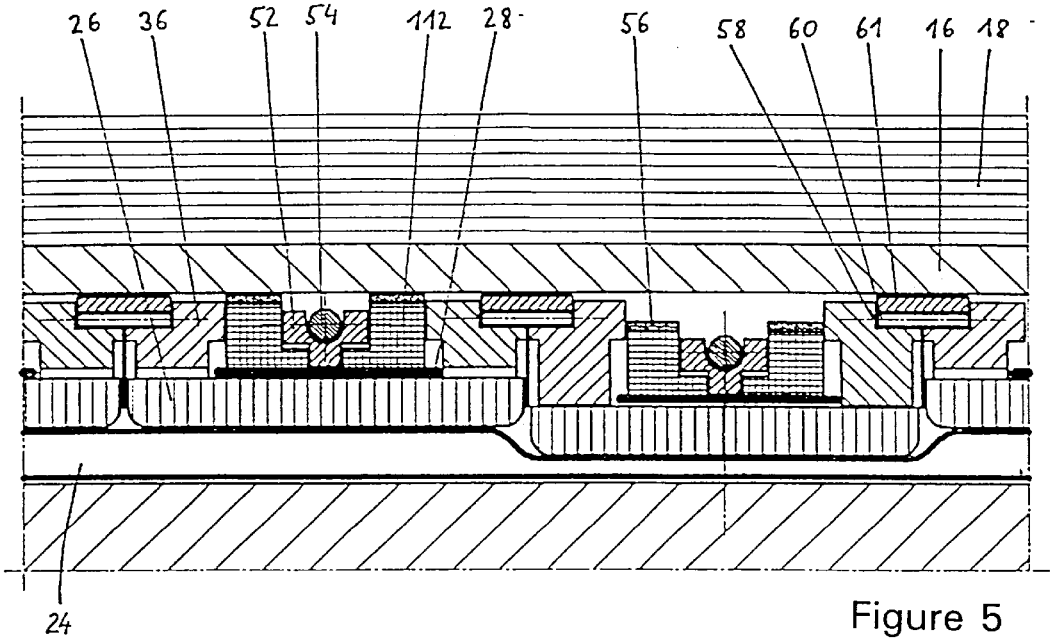
Figure 6:
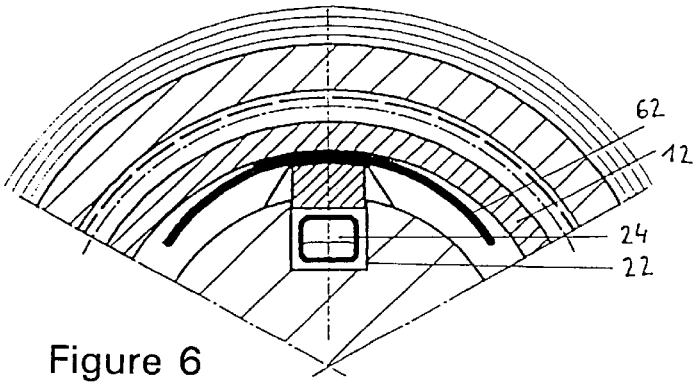
Figure 7:
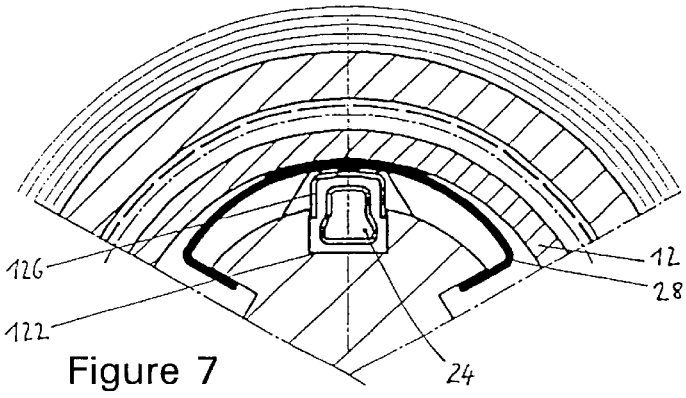
Figure 8:
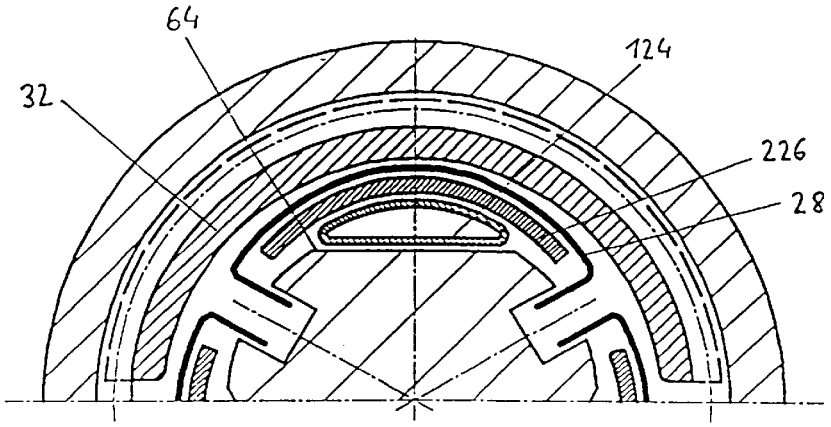
Figure 9:
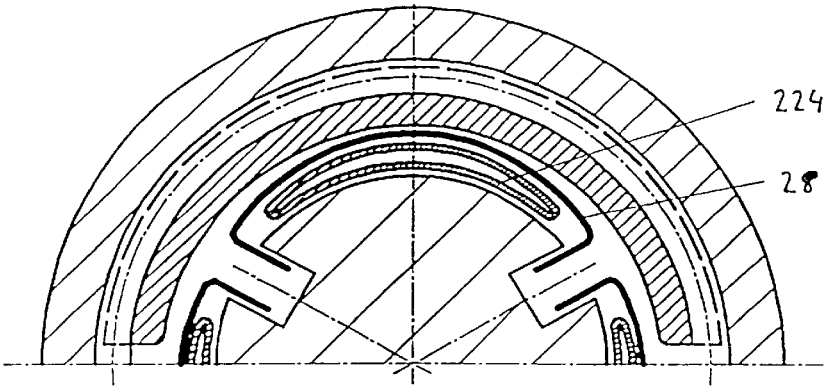
Figure 10:
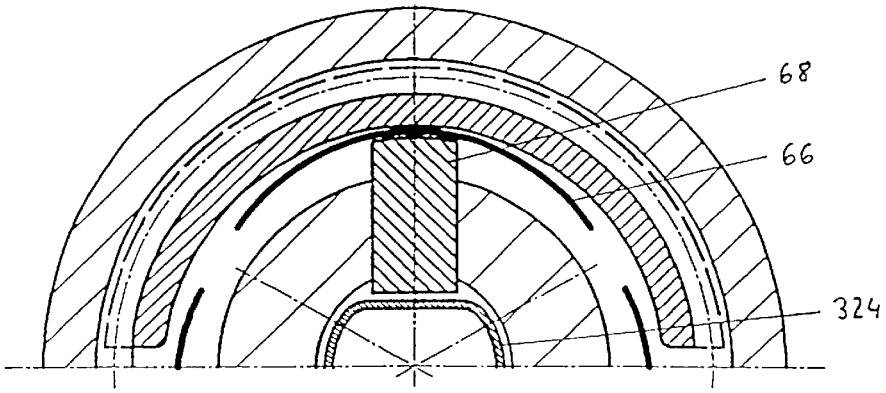
Figure 11:
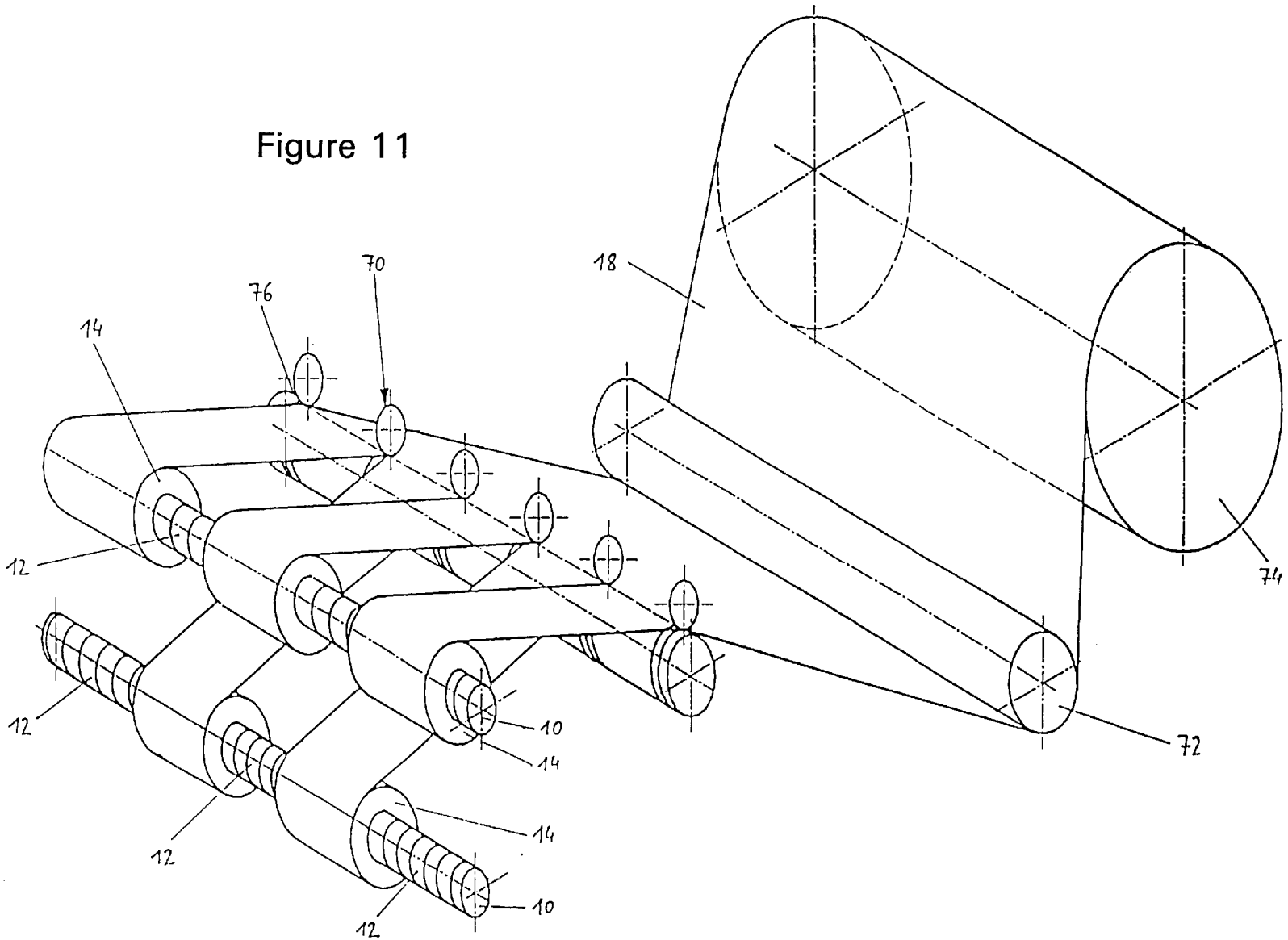

Some embodiments of the invention will be described below in conjunction with the drawing. It shows:

FIG. 1, an axial half-section with a side view of a friction winding shaft with a product roll fastened on it and having a coil core;

FIG. 2, a cross section through the friction winding shaft with a product roll in the plane I—I of FIG. 1;

FIG. 3, a cross section through the friction winding shaft in the plane II—II of FIG. 1;

FIG. 4, a cross section through an embodiment for locking a tension element;

FIG. 5, an enlarged detail in the longitudinal direction of the friction shaft with further embodiments of a friction ring and support ring;

FIG. 6, a fragmentary section through a further embodiment of a combined coupling and pressure element;

FIG. 7, a fragmentary section through a further embodiment of a pressure element with a reduced groove depth;

FIG. 8, a fragmentary section through an embodiment for designing the groove of the pressure element and of the pressure chamber;

FIG. 9, a further embodiment of the pressure chamber;

FIG. 10, a fragmentary section through a friction winding shaft with a pressure chamber in the middle of the shaft; and FIG. 11, a schematic oblique view of a longitudinal cutting machine with friction winding shafts.

In FIG. 1, a portion of a friction winding shaft 10 is shown, fully equipped with friction rings 12. A product roll 14 comprises a coil core 16 and a weblike product 18 to be wound and can be disposed in an arbitrary position—depending on the graduation of the cutters—on the longitudinal axis of the friction winding shaft 10. In the example shown, the role 14 on the right-hand side is not flush with the boundary of the friction ring 12.1 located there.

The friction winding shaft 10 has a core shaft 20 and a plurality of expandable elastic pressure chambers 24 (FIG. 2) placed each in one groove 22. These elastic pressure chambers 24 act on the friction rings 12, in that the radial pressure forces are transmitted to coupling elements 28 via pressure elements 26. The coupling elements 28 in turn pass this radial pressure on outward to the friction rings 12 to firmly clamp the coil core 16. The friction rings 12 have at least one dividing seam 30 of the circumference, so that they, or in this example the split rings 32, are movable outward under the radial force. Preferably the tension elements comprise one or more pressure chambers, which upon pressure imposition by a pressure fluid flowing through them exert a radially outward-oriented force on the coupling elements in the operating position, in which process the flowing pressure fluid dissipates the heat of friction.

The dividing seam 30 should extend obliquely to the end face of the coupling elements 28, so that the torque transmission from the coupling elements 28 to the coupling rings 12 is effected with as little jerking as possible. The friction rings 12 are held together on the outer circumference by elastic rings 34 (such as O-rings). By this provision, the friction between the friction rings 12 and the coil core 16 can also be increased. The friction rings 12 are axially guided in support rings 36. The support rings 36 are rotatably connected to the core shaft 20. Supported on the support rings 36 are elastic elements 38 (such as spring clips; see also FIG. 3), which when the pressure chambers 24 relax press the pressure elements 26 back via the coupling elements and positively displace the air out of the pressure chambers. The elastic elements 38 are preferably embodied in one piece with the coupling elements 28. The elastic rings 34 can thus compress the friction rings 12 to the minimum diameter and can release the coil core 16 so that the product roll 14 can be loaded on and unloaded.

The radial pressure force necessary for the restoration can also be brought to bear by the elastic rings 34 alone. But in that case some of the radial force is unavailable for firmly clamping the coil core 16 and instead acts only between the coupling elements 28 and the friction rings 12.

The support rings 36 bring about an axial fixation of the friction rings 12 and serve as an abutment for the elastic elements 38.

In the position shown for the roll 14, there is too little overlap between the friction element 12.1 and the coil core 16. There is the risk that the torque transmission between this friction element 12.1 and the coil core 16 will not be reliably assured. A relative motion could abrade the coil core, which can be a serious problem when the product 18 being wound is used. To prevent this, the support rings 36, which belong to the friction element 12.1, have been rotated by an angular amount (see also FIG. 3). This radially fixes the pressure elements 26, and they cannot press the friction element 12 outward toward the coil core 16. This takes the tension element out of action.

To enable detecting the position of the support rings 36 with respect to the adjacent support rings and hence learning the functional state of the friction elements 12, all the support rings 36 are provided with a marking 40.

For the sake of simplicity, the support rings 36 of adjacent friction rings 12 can also be combined into one support ring 136. Some of the support rings 136 can be firmly clamped on the core shaft (20).

The friction rings 12, which are positioned outside the region overlapped by the coil core 16, need not be put out of action. When pressure is exerted on the pressure chambers 24, the pressure elements 26 are pressed against the support rings 36. The friction rings 12 widen to their maximum diameter, but when the pressure in the pressure chambers 24 drops they move back to their minimum diameter and clear the way for removal of the fully wound roll 14.

It is unnecessary to split the friction rings 12 if the rings are made from a sufficiently elastic material, which is optionally coated on the inner frictional surface with a suitable material, which adjusts the relation of the coefficients of friction between the outer and inner surfaces in such a way that the necessary relative motion always takes place at the inside diameter of the friction rings 12, rather than between the friction ring 12 and the coil core 16.

FIG. 2 shows a cross section in the plane I—I of FIG. 1. The coupling elements 28 are bent radially toward the shaft center on both ends, and each of these bent ends 42 protrudes into a groove 44 in the shaft. The result is a positive torque transmission from the core shaft 20 to the coupling elements 28. The coupling elements 28 can transmit friction forces, as a result of the normal to surface forces originating in the pressure chambers 24, in accordance with the existing coefficients of friction between the coupling elements 28 and the friction rings 12. Because of the different inside diameters of the friction ring and of the coil core and by a selection of the coefficients of friction (materials), slippage between the rings 12 and the coil core 16 can be averted.

The axial guidance of the split friction rings 12 is effected via the support rings 36. The support rings 36 have axially extending recesses 46 on their circumference, which provide freedom of motion for the pressure elements 26.

FIG. 3 shows a cross section in the plane II—II of FIG. 1. The support rings 36 are rotated by approximately 60° relative to the support rings in connection with FIG. 1. The friction element 12 is out of action, as described in FIG. 1. In this illustration, the spring elements are shown as spring clips 38, which are secured against rotation by bores 48 in the support ring 36. Still other spring elements are also conceivable (such as rubber blocks, helical springs, ring springs).

FIG. 4 shows a variant for the support rings 236, in which at least one shallow groove 50 is provided on the inside circumference of the support rings 236. The effect of this groove 50 is that in the inactivated state, the pressure element 26 engages the groove 50 with pressure imposition, and unintentional rotation of the support rings 26 and thus activation of the respective friction element are averted. This detent function could also be effected by other devices (such as a ball catch).

FIG. 5 shows a version in which the friction rings 12 are separated into a plurality of parts. The circumferentially divided friction rings 112 are not held together by an elastic ring. The circumferentially split ring 52 resting on the coupling elements 28 is designed, in conjunction with a spring element 54, in such a way that when the pressure chamber 24 is relaxed, the entire contact-pressure system, comprising the pressure elements 26, the coupling elements 28, and the two split friction rings 112, is pressed radially inward so far that the outer circumference of the friction rings 112 does not protrude past the outer circumference of the support rings 36. The association of the restoring function with a separate restoring ring 52 assures that the normal to surface force necessary for torque transmission is also passed on completely in the form of tensioning force to the coil core 16, which effects a secure fixation of the coil core 16. Thus the elastic element 34 can be omitted. For better slaving of the coil core 16, the friction rings 112 may also be provided with a material with a high coefficient of friction, or with profiling, on the circumference 56.

In FIG. 5, the support rings 36 are provided with a recess 58 for receiving roller bodies 60 (such as needle bearings) and a guide ring 61 adapted to the inside diameter of the coil core. The thus-formed radial bearing brings about better concentricity of the product roll 14.

FIG. 6 shows an embodiment in which the coupling elements and pressure elements (FIG. 2) are combined into one component 62. The torque transmission is thus effected from the groove 22 to the component 62 and onward to the friction ring 12. The grooves 44 can thus be dispensed with.

FIG. 7 shows an embodiment in which the pressure element 26 is embodied as a U-shaped part 126. The pressure chamber 24 is placed in this part 126. The groove 122 can thus be made correspondingly more shallow.

FIG. 8 shows an embodiment in which the pressure chamber 124 is not accommodated in a groove but rather in a flattened face 64. The pressure element here is embodied as a tubular segment 226. The recess 46, not shown in this drawing, in the support ring 36 must be adapted accordingly.

FIG. 9 shows an embodiment in which the pressure chamber 224 extends over nearly the entire region of the coupling element 28.

FIG. 10 shows an embodiment in which the pressure chamber is disposed in the form of a common chamber 324 in the middle of the shaft. The transmission of the pressure forces to the coupling elements 66 is effected by the thrust piece 68. If the two elements are combined, then no further grooves are necessary for torque transmission.

FIG. 11 shows a longitudinal cutting machine 70, in which two friction winding shafts 10 are provided for winding the product rolls 14. The product 18 to be wound is unwound from a mother roll 74 with the aid of a main drive mechanism 72, shown in highly simplified form, and is delivered at constant speed to a cutting unit 76. This unit cuts the product 18 to be wound into narrow webs, which are wound onto alternating product rolls 14 that are fastened on the upper and lower friction winding shaft 10. A drive mechanism (not shown) for the two friction winding shafts 10 assures that the winding speed of the friction winding shaft is always higher than the winding speed of the product rolls 14. The result is a relative motion between the friction elements and the coupling elements and thus the desired buildup of torque for the individual product rolls. Differences in diameter can be compensated for by means of adapting the winding speed of the product rolls, without undesirably increasing the torques. The quantity of the torque for each individual product roll is obtained from the number, corresponding to the core length, of friction elements in engagement.

No attempt has been made to illustrate such peripheral conditions as the support and drive of the friction winding shaft, delivery of the pressure medium, etc., since this is equivalent to the prior art. There are also cases in which the pressure level is varied for changing the torque during the winding operation.

In the embodiments described, the functional units of the pressure chamber, pressure element, coupling element, etc., are always disposed in triplicate around the circumference of the shaft. This is intended merely as an example and is not compulsory for attaining the object of the invention. The number of friction rings 12 is not fixed, either.

I claim:

1. A winding shaft for winding striplike materials onto coil cores, having a driven core shaft, friction rings that annularly surround the core shaft, and radially acting tension elements, which in the operational position bring about a coupling engagement between coupling elements, slaved by the core shaft, and the friction rings, by which torque can be transmitted with slip from the core shaft to the friction rings, the friction rings being movable outward, in order to establish a rotationally fixed connection during operation between the friction rings and the coil core, characterized in that the tension elements, by means of the radial forces imposed by them, move the friction rings radially outward via the coupling elements and put them in contact with the coil core; and that under the radial forces of the tension elements, which forces are operative in the operating position, the torque transmitted by the frictional pairing between the coupling element and the friction is under the torque that can be transmitted by the pairing of friction ring and coil core, so that a rotationally fixed slaving occurs between the friction ring and the coil core.

2. The winding shaft of claim 1, characterized in that the friction rings are axially guided between support rings that rotate with the core shaft.

3. The winding shaft of claim 2, characterized in that at least some of the support rings are rotatable relative to the core shaft into a position in which the associated coupling elements are blocked even if the tension elements are activated.

4. The winding shaft of claim 3, characterized in that some of the support rings can be firmly clamped on the core shaft.

5. The winding shaft of claim 1, characterized in that the coupling elements are secured against relative rotation in radial indentations in the core shaft.

6. The winding shaft of claim 1, characterized in that the friction rings form an integral slit ring which comprises elastic material.

7. The winding shaft of claim 1, characterized in that the friction rings are prestressed in the direction of their position of repose by elastic restoring means.

8. The winding shaft of claim 1, characterized in that the coupling elements are prestressed in the direction of their position of repose by elastic means.

9. The winding shaft of claim 8, characterized in that an elastic ring extends in a circumferential groove of a restoring ring, which restoring ring, in the operating position, exerts a radial restoring force only on the coupling elements and at the transition to the position of repose slaves the friction rings radially inward.

10. The winding shaft of claim 1, characterized in that the tension elements comprise one or more pressure chambers, which upon pressure imposition by a pressure fluid flowing through them exert a radially outward-oriented force on the coupling elements in the operating position, in which process the flowing pressure fluid dissipates the heat of friction.

* * * * *